US011859825B1

(12) United States Patent
Guo

(10) Patent No.: US 11,859,825 B1
(45) Date of Patent: Jan. 2, 2024

(54) COMBUSTION FURNACE WITH CONTROLLABLE FIREPOWER

(71) Applicant: Ninghao Guo, Ningbo (CN)

(72) Inventor: Ninghao Guo, Ningbo (CN)

( * ) Notice: Subject to any disclaimer, the term of this patent is extended or adjusted under 35 U.S.C. 154(b) by 0 days.

(21) Appl. No.: 18/171,252

(22) Filed: Feb. 17, 2023

(30) Foreign Application Priority Data

Jan. 19, 2023 (CN) ..... 202320181246.8

(51) Int. Cl.
*F24B 1/19* (2006.01)

(52) U.S. Cl.
CPC ..... *F24B 1/19* (2013.01)

(58) Field of Classification Search
CPC ..... F24F 13/12
See application file for complete search history.

(56) References Cited

U.S. PATENT DOCUMENTS 682,826 A * 9/1901 Buck ..... F24B 1/1895 126/539
2022/0186931 A1* 6/2022 Jan ..... F24B 1/182

FOREIGN PATENT DOCUMENTS

CN 209924878 U * 1/2020

* cited by examiner

*Primary Examiner* — Jason Lau

(57) ABSTRACT

The present disclosure provides a combustion furnace with controllable firepower, including a furnace body, wherein the furnace body is provided with a combustion chamber in which combustible materials are placed, wherein the furnace body further includes an adjusting mechanism and an air inlet, the air inlet is provided on the side wall of the furnace body and is configured to be communicated with the combustion chamber, the adjusting mechanism includes a baffle, the baffle is provided at the air inlet and closely clings to the side wall of the furnace body to turn off the air inlet, and the baffle is configured to move up and down with respect to the furnace body to control the air inlet to be turned on and off.

20 Claims, 10 Drawing Sheets

COMBUSTION FURNACE WITH CONTROLLABLE FIREPOWER

CROSS-REFERENCE TO RELATED APPLICATIONS

The application claims priority of Chinese patent application CN202320181246.8, filed on Jan. 19, 2023, which is incorporated herein by reference in its entireties.

TECHNICAL FIELD

The present disclosure relates to the technical field of combustion furnace devices, in particular to a combustion furnace with controllable firepower.

BACKGROUND

With the gradual improvement of people's living standards, outdoor sports are becoming more and more popular in people's lives. In outdoor sports, such as mountaineering, exploration and long-distance travel, picnics are often indispensable, and a combustion furnace is usually used in the process of picnics. However, the existing combustion furnace is relatively simple in structure, and it is difficult to adjust the firepower and adapt to different application scenarios.

SUMMARY

The technical solution adopted by the present disclosure to solve the technical problem is as follows: the present disclosure provides a combustion furnace with controllable firepower, including a furnace body, wherein the furnace body is provided with a combustion chamber in which combustible materials are placed, wherein the furnace body further includes an adjusting mechanism and an air inlet, the air inlet is provided on the side wall of the furnace body and is configured to be communicated with the combustion chamber, the adjusting mechanism includes a baffle, the baffle is provided at the air inlet and closely clings to the side wall of the furnace body to turn off the air inlet, and the baffle is configured to move up and down with respect to the furnace body to control the air inlet to be turned on and off.

Further, the adjusting mechanism further includes a hand-held part, a connecting part and a connecting rod, the side wall of the furnace body is longitudinally provided with a sliding groove, one end of the connecting part is connected with the hand-held part, the other end thereof is connected with one end of the connecting rod through the sliding groove, and the other end of the connecting rod is connected with the baffle.

Further, a combustion rack in which combustible materials are placed is provided in the combustion chamber, the combustion chamber forms a lower chamber below the combustion rack, a plurality of wind shields are provided in the lower chamber to divide the lower chamber into a plurality of chamber units, and the combustion rack is erected on the top of the wind shields.

Further, a storage rack is further provided in the combustion chamber, the storage rack is provided below the combustion rack, and the combustion rack is provided with a plurality of through-holes, so that the ashes after burning combustible materials fall into the storage rack through the through-holes.

Further, the bottom of the wind shield is provided with a protrusion extending outward, and the storage rack is erected on the protrusion.

Further, the furnace body includes a first furnace body unit and a second furnace body unit, and the second furnace body unit is provided in the first furnace body unit; the bottom wall of the second furnace body unit is higher than the bottom wall of the first furnace body unit to form a second air passage between the bottom wall of the first furnace body unit and the bottom wall of the second furnace body unit; the air inlet is provided at the bottom of the side wall of the first furnace body unit, the combustion chamber is provided in the second furnace body unit, and the bottom wall of the second furnace body unit is provided with an opening to realize the communication among the combustion chamber and the second air passage.

Further, the baffle is provided at the bottom of the first furnace body unit and closely clings to the first furnace body unit, and the sliding groove is provided on the side wall of the first furnace body unit.

Further, the inner diameter of the second furnace body unit is smaller than the inner diameter of the first furnace body unit to form a first air passage between the side wall of the first furnace body unit and the side wall of the second furnace body unit.

Further, the combustion chamber forms an upper chamber above the combustion rack, the side wall of the upper chamber is provided with an air outlet, and air enters the first air passage through the air inlet and then enters the upper chamber through the air outlet.

Further, further including abase, wherein the base is provided below the furnace body for supporting the furnace body.

A combustion furnace with controllable firepower, including a furnace body, the furnace body provided with a combustion chamber in which combustible materials are placed, the furnace body further including an adjusting mechanism and an air inlet, the air inlet provided on the side wall of the furnace body and configured to be communicated with the combustion chamber, the adjusting mechanism including a baffle, the baffle provided at the air inlet and configured to move up and down with respect to the furnace body to control the air inlet to be turned on and off, wherein the baffle is controlled to move upward so as to turn on the air inlet to increase firepower of the combustible materials and the baffle is controlled to move downward so as to turn off the air inlet to discrease the firepower of the combustible materials.

Further, the adjusting mechanism further includes a hand-held part, a connecting part and a connecting rod, the side wall of the furnace body is longitudinally provided with a sliding groove, one end of the connecting part is connected with the hand-held part, the other end thereof is connected with one end of the connecting rod through the sliding groove, and the other end of the connecting rod is connected with the baffle.

Further, a combustion rack in which combustible materials are placed is provided in the combustion chamber, the combustion chamber forms a lower chamber below the combustion rack, a plurality of wind shields are provided in the lower chamber to divide the lower chamber into a plurality of chamber units, and the combustion rack is erected on the top of the wind shields.

Further, a storage rack is further provided in the combustion chamber, the storage rack is provided below the combustion rack, and the combustion rack is provided with a plurality of through-holes, so that the ashes after burning combustible materials fall into the storage rack through the through-holes.

Further, the bottom of the wind shield is provided with a protrusion extending outward, and the storage rack is erected on the protrusion.

Further, the furnace body includes a first furnace body unit and a second furnace body unit, and the second furnace body unit is provided in the first furnace body unit; the bottom wall of the second furnace body unit is higher than the bottom wall of the first furnace body unit to form a second air passage between the bottom wall of the first furnace body unit and the bottom wall of the second furnace body unit; the air inlet is provided at the bottom of the side wall of the first furnace body unit, the combustion chamber is provided in the second furnace body unit, and the bottom wall of the second furnace body unit is provided with an opening to realize the communication among the combustion chamber, the second air passage and the air inlet.

Further, the baffle is provided at the bottom of the first furnace body unit and closely clings to the first furnace body unit, and the sliding groove is provided on the side wall of the first furnace body unit.

Further, the inner diameter of the second furnace body unit is smaller than the inner diameter of the first furnace body unit to form a first air passage between the side wall of the first furnace body unit and the side wall of the second furnace body unit.

Further, the combustion chamber forms an upper chamber above the combustion rack, the side wall of the upper chamber is provided with an air outlet, and air enters the first air passage through the air inlet and then enters the upper chamber through the air outlet.

Further, further including a base, wherein the base is provided below the furnace body for supporting the furnace body.

Beneficial effects: the combustion furnace with controllable firepower according to the present disclosure is provided with an adjusting mechanism and an air inlet, and the air inlet is provided on the side wall of the furnace body and is communicated with the combustion chamber. The adjusting mechanism includes a baffle. The baffle is provided at the air inlet and closely clings to the side wall of the furnace body to turn off the air inlet, and the baffle is configured to move up and down with respect to the furnace body to control the air inlet to be turned on and off.

Through the above structural arrangement, when the firepower needs to be increased, the baffle can be controlled to move upward, so as to turn on the air inlet. After the air inlet is turned on, oxygen in the combustion chamber is continuously consumed along with the combustion of combustible materials, so that the external air enters the combustion chamber through the air inlet, and the combustion of combustible materials is stronger. When the firepower needs to be decreased, the baffle can be controlled to move downward, so as to turn off the air inlet. After the air inlet is turned off, the combustion intensity of combustible materials will be gradually weakened along with the continuous consumption of oxygen in the combustion chamber, so as to prolong the combustion time of combustible materials. Through the above structural arrangement, users can adjust the firepower of the combustion furnace by controlling the adjusting mechanism, so as to meet different requirements. The combustion furnace with controllable firepower is simple in operation and strong in practicality.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
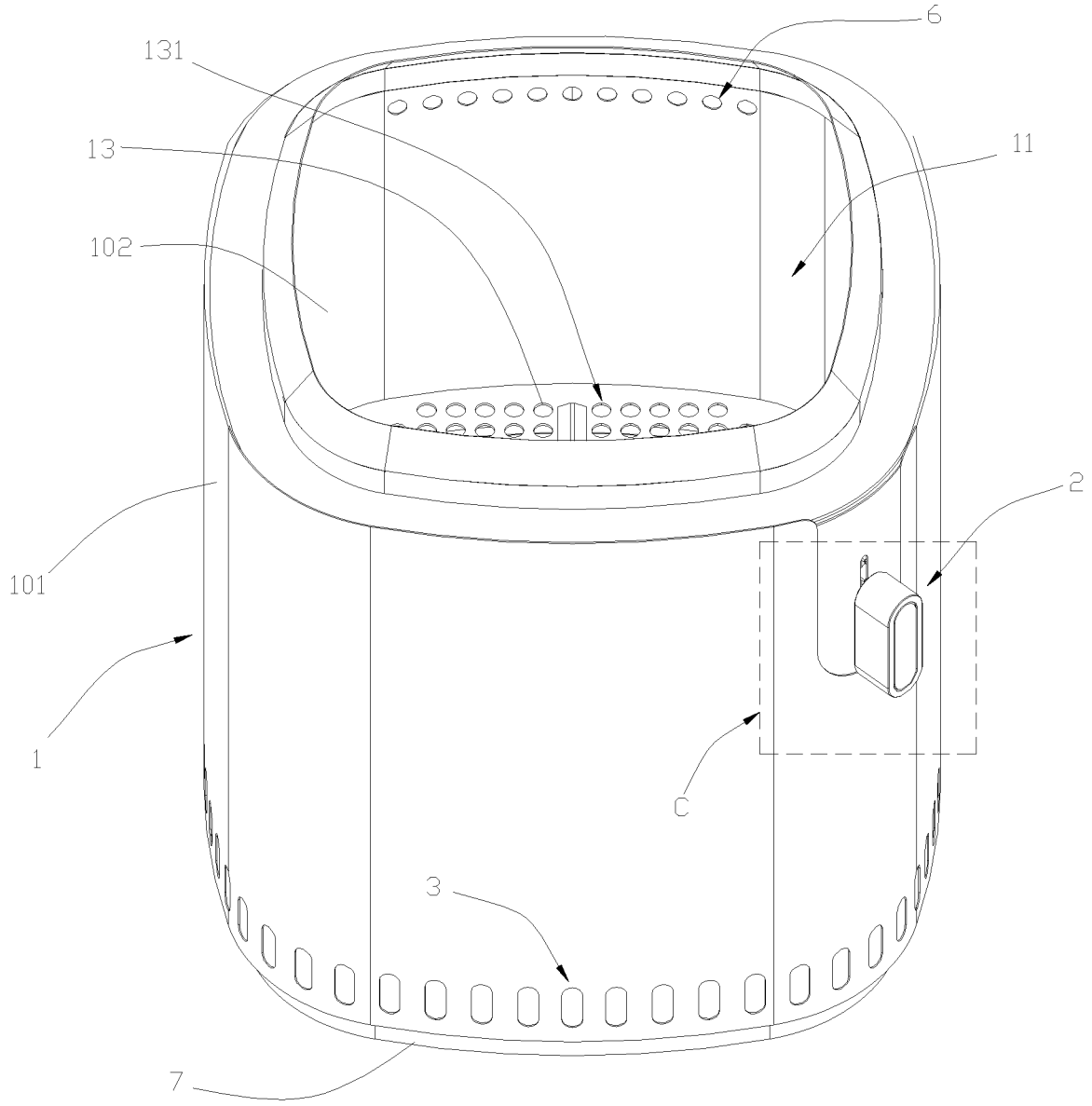
FIG. 1 shows a perspective diagram of a combustion furnace according to this embodiment.
Figure 2:
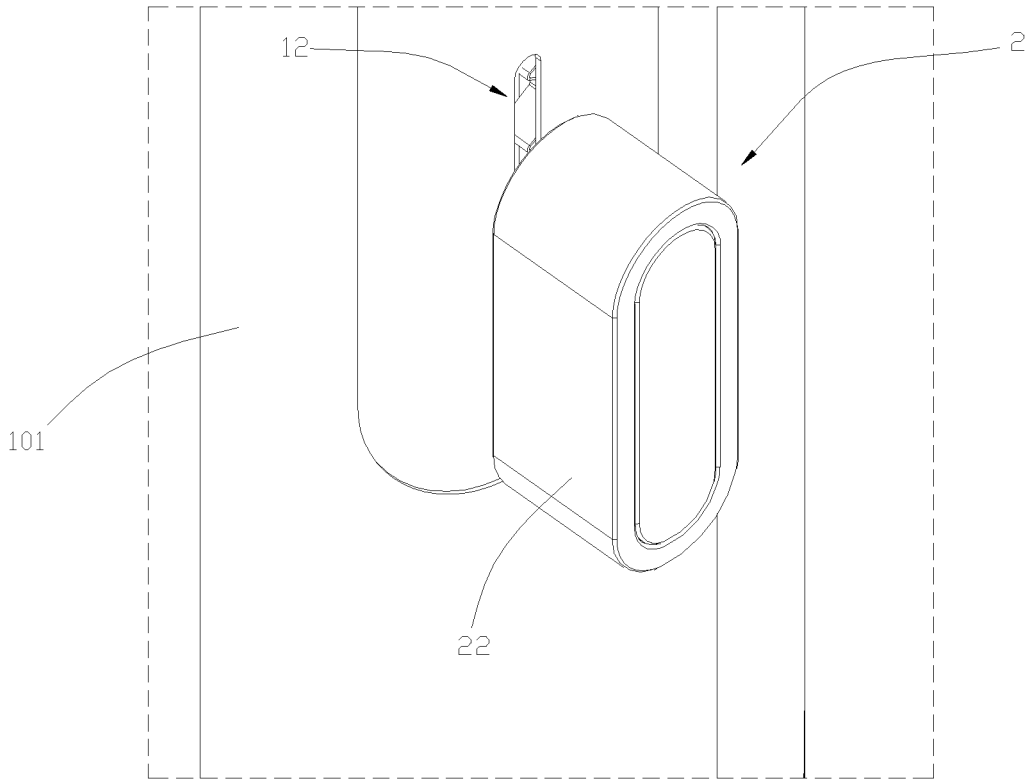
FIG. 2 shows a partial enlarged diagram at C, in which a hand-held part is positioned below a sliding groove.
Figure 3:
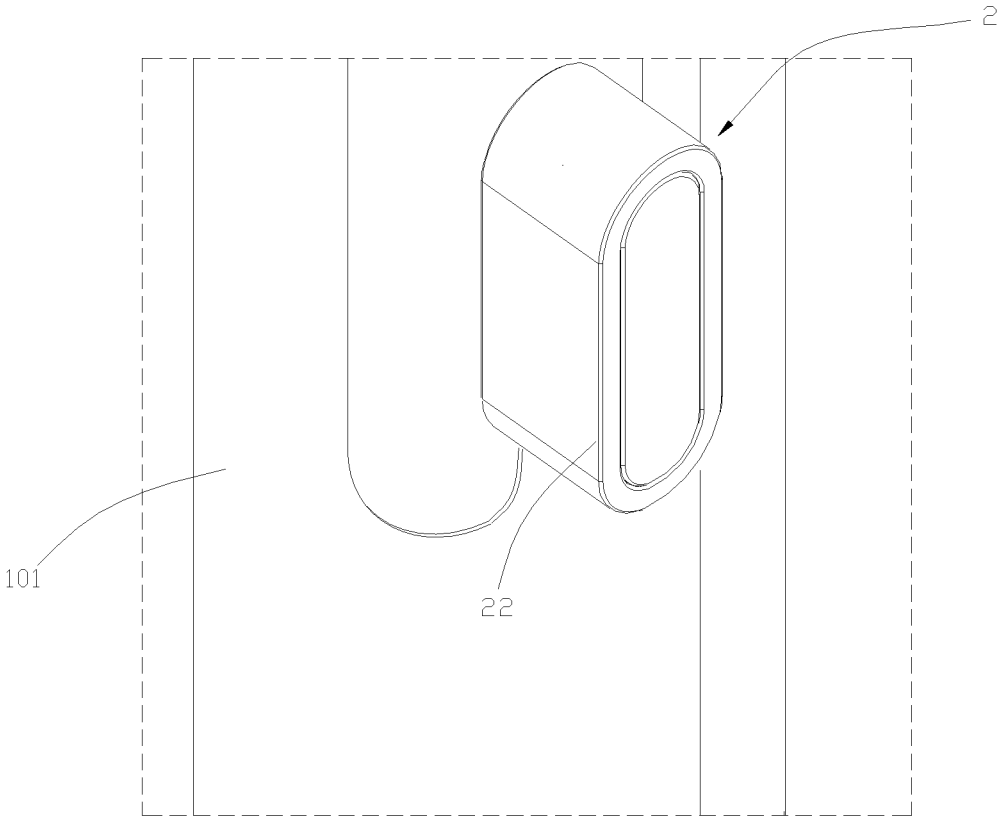
FIG. 3 shows a schematic diagram of a hand-held part positioned above a sliding groove.

It is to be noted that embodiments in the present disclosure and features in the embodiments may be combined with each other without conflict.

In the description of the present disclosure, It is to be understood that, The terms "center", "longitudinal", "transverse", "upper", "lower", "front", "rear", "left", "right", "verti cal", "horizontal", "top", "bottom", "inner", "outer", "clockwise", and the like indicate azimuth or positional relationships based on the azimuth or positional relationships shown in the drawings, For purposes of convenience only of describing thepresent disclosure and simplifying the description, Rather than indicating or implying that the indicated device or element must have a particular orientation, be constructed and operated in a particular orientation, therefore, not to be construed as limiting the present disclosure; in addition, The terms "first" and "second" are used for descriptive purposes only, While not to be construed as indicating or implying relative importance or implicitly specifying the number of technical features indicated thereby, features defining "first," "second," and "second" may explicitly or implicitly include one or more of the described features. In the description of the present disclosure, "multiple" means two or more unless explicitly specified otherwise.

In the description of the present disclosure, it is to be noted that unless otherwise expressly specified and defined, the terms "mounted", "connected", and "connected" are to be construed broadly, for example, as either a fixed connection, or a detachable connection, or an integral connection, either a mechanical connection, or an electrical connection. The specific meaning of the above term in the present disclosure will be understood by those of ordinary skill in the art depending on the particular circumstances, either directly or indirectly via an intermediate medium, communication between the two elements, or interaction between the two elements.

The specific embodiments of the present disclosure are described in details in combination with the drawings.

As shown in FIG. 1 to FIG. 10, this embodiment provides a combustion furnace with controllable firepower. The combustion furnace includes a square furnace body 1. The furnace body 1 is provided with a combustion chamber 11 in which other combustible materials such as wood are placed. The combustion chamber 11 forms a port above the furnace body 1, into which wood is put. Further, a plurality of air inlets 3 are provided below the side wall of the furnace body 1. The air inlets 3 are provided around the furnace body 1 and are configured to be communicated with the combustion chamber 11. When wood burns in the combustion chamber 11, air can enter the combustion chamber 11 through the air inlets 3, so that the wood can be fully burned. Further, the combustion furnace of this embodiment is further provided with an adjusting mechanism 2. The adjusting mechanism 2 is configured to control the air inlets 3 to be turned on or off.

Figure 9:
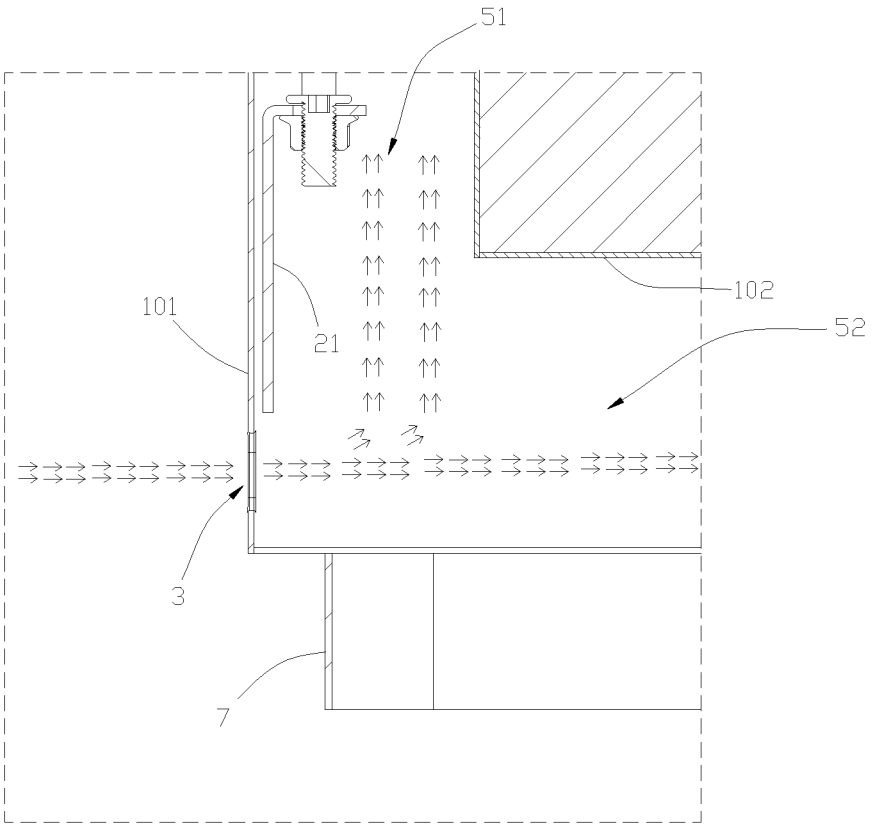
FIG. 9 shows a schematic diagram of an air inlet of FIG. 8 in an OFF state (the arrow in the figure indicates the air flow direction).
Figure 10:
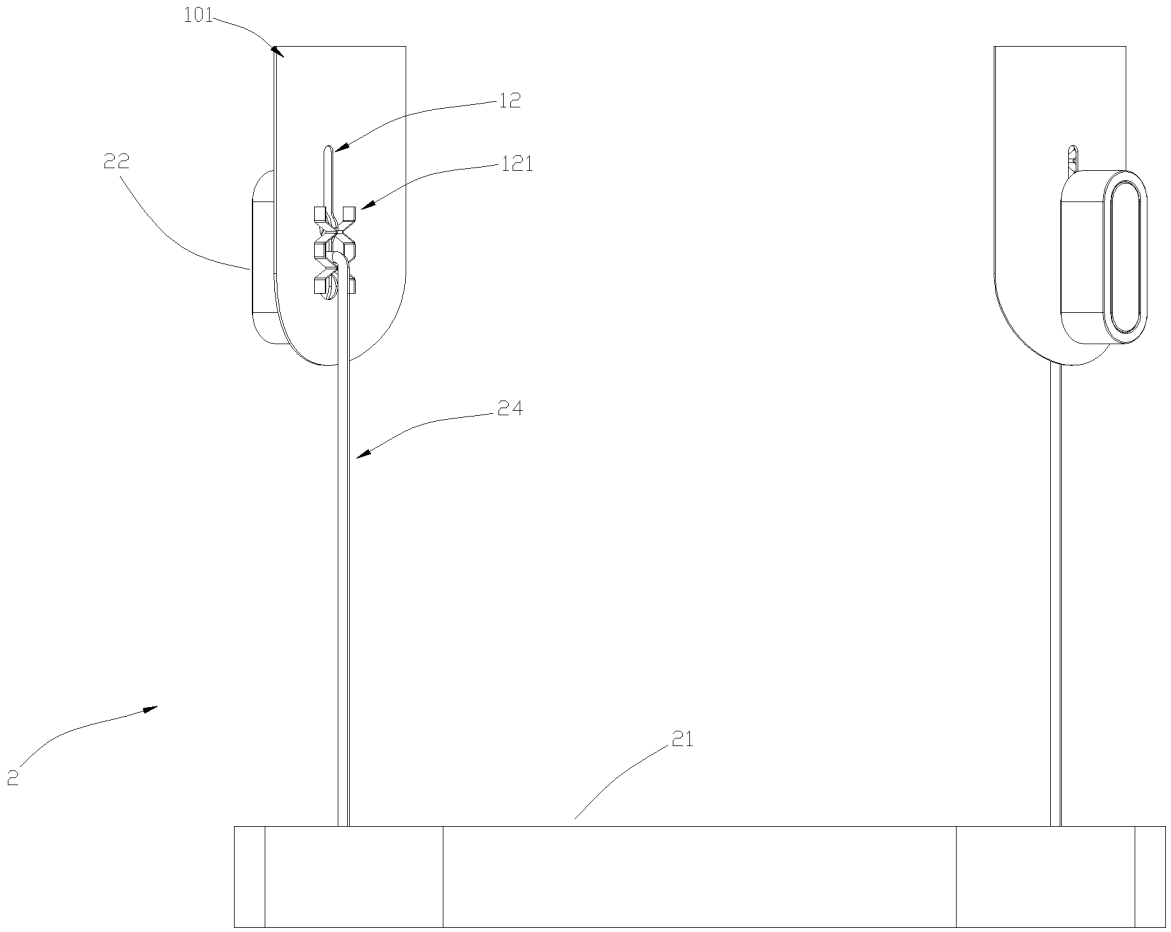
FIG. 10 shows a perspective diagram of an adjusting mechanism according to this embodiment.

When in use, users can put the wood into the combustion chamber 11 through the opening 1021 to ignite the wood. When the firepower needs to be increased, the adjusting mechanism 2 can be controlled to turn on the air inlet 3. As shown in FIG. 9, after the air inlet 3 is turned on, oxygen in the combustion chamber 11 is continuously consumed along with the combustion of the wood, so that the external air enters the combustion chamber 11 through the air inlet 3, and the combustion of the wood is stronger. When the firepower needs to be decreased, the adjusting mechanism 2 can be controlled to turn off the air inlet 3. After the air inlet 3 is turned off, the combustion intensity of wood will be gradually weakened along with the continuous consumption of oxygen in the combustion chamber 11, so as to prolong the combustion time of wood. Through the above structural arrangement, users can adjust the firepower of the combustion furnace by controlling the adjusting mechanism 2, so as to meet different requirements. The combustion furnace with controllable firepower is simple in operation and strong in practicality.

Specifically, the adjusting mechanism 2 of this embodiment includes a baffle 21. The shape of the baffle 21 matches the shape of the furnace body 1. The baffle 21 is provided at the bottom of the side wall of the furnace body and closely clings to the side wall of the furnace body 1 to block the air inlet 3. Further, the baffle 21 can move up and down with respect to the side wall of the furnace body 1 to control the air inlet 3 to be turned on and off.

Through the above structural arrangement, when the firepower needs to be adjusted to the maximum, the baffle 21 can be moved upward to keep the baffle 21 away from the air inlet 3, so as to turn on the air inlet 3 of the furnace body 1. When the firepower needs to be decreased, the baffle 21 can be moved downward to block the air inlet 3, so as to turn off the air inlet 3 of the furnace body 1. The combustion furnace with controllable firepower is simple in structure and ingenious in design.

Further, the adjusting mechanism 2 of this embodiment further includes a hand-held part 22, a connecting part 23 and a connecting rod 24. The top of the side wall of the furnace body 1 is longitudinally provided with a sliding groove 12. One end of the connecting part 23 is connected with the hand-held part 22, and the other end thereof is connected with one end of the connecting rod 24 through the sliding groove 12. The other end of the connecting rod 24 is connected with the baffle 21.

Through the above structural arrangement, when the baffle 21 needs to be moved upward, the hand-held part 22 can be pushed upward, so that the connecting part 23 translates upward in the sliding groove 12, so as to drive the connecting rod 24 to move upward. The connecting rod 24 moving upward will drive the baffle 21 to move upward in the furnace body 1, so as to turn on the air inlet 3. Similarly, when the baffle 21 needs to be moved downward, the hand-held part 22 can be pushed downward, so that the connecting part 23 translate downward in the sliding groove 12, so as to drive the connecting rod 24 to move downward. The connecting rod 24 moving downward will drive the baffle 21 to move downward in the furnace body 1, so as to turn off the air inlet 3. The other end of the connecting rod 24 includes a screw, the baffle 21 includes a main body configured to turn off the air inlet 3 and a connection plate connected an end of the main body. The connection plate includes a first threaded hole, the screw passes through the first threaded hole, and a nut is fixed on the screw to connect the connecting rod and the baffle 21.

Figure 4:
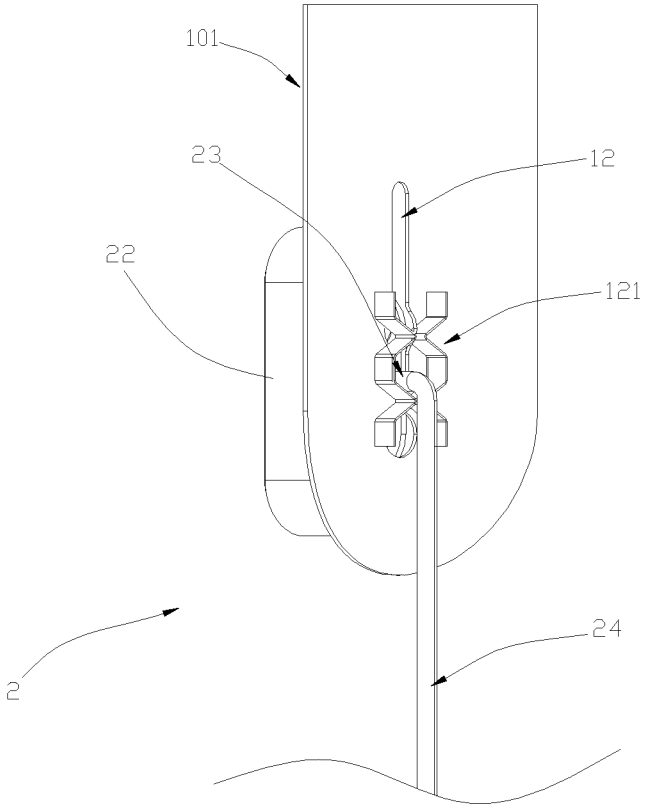
FIG. 4 shows a schematic diagram of a connection relationship between a connecting part and a stopper of FIG. 2.
Figure 5:
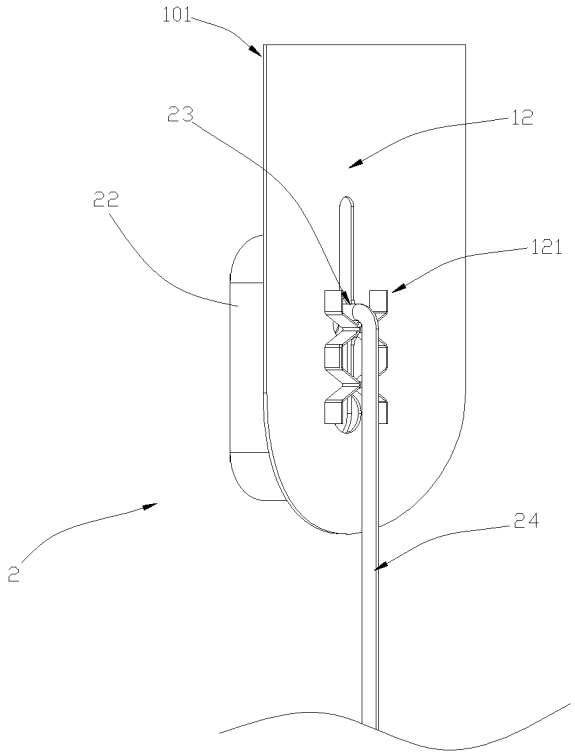
FIG. 5 shows a schematic diagram of a connection relationship between a connecting part and a stopper of FIG. 3.
Figure 6:
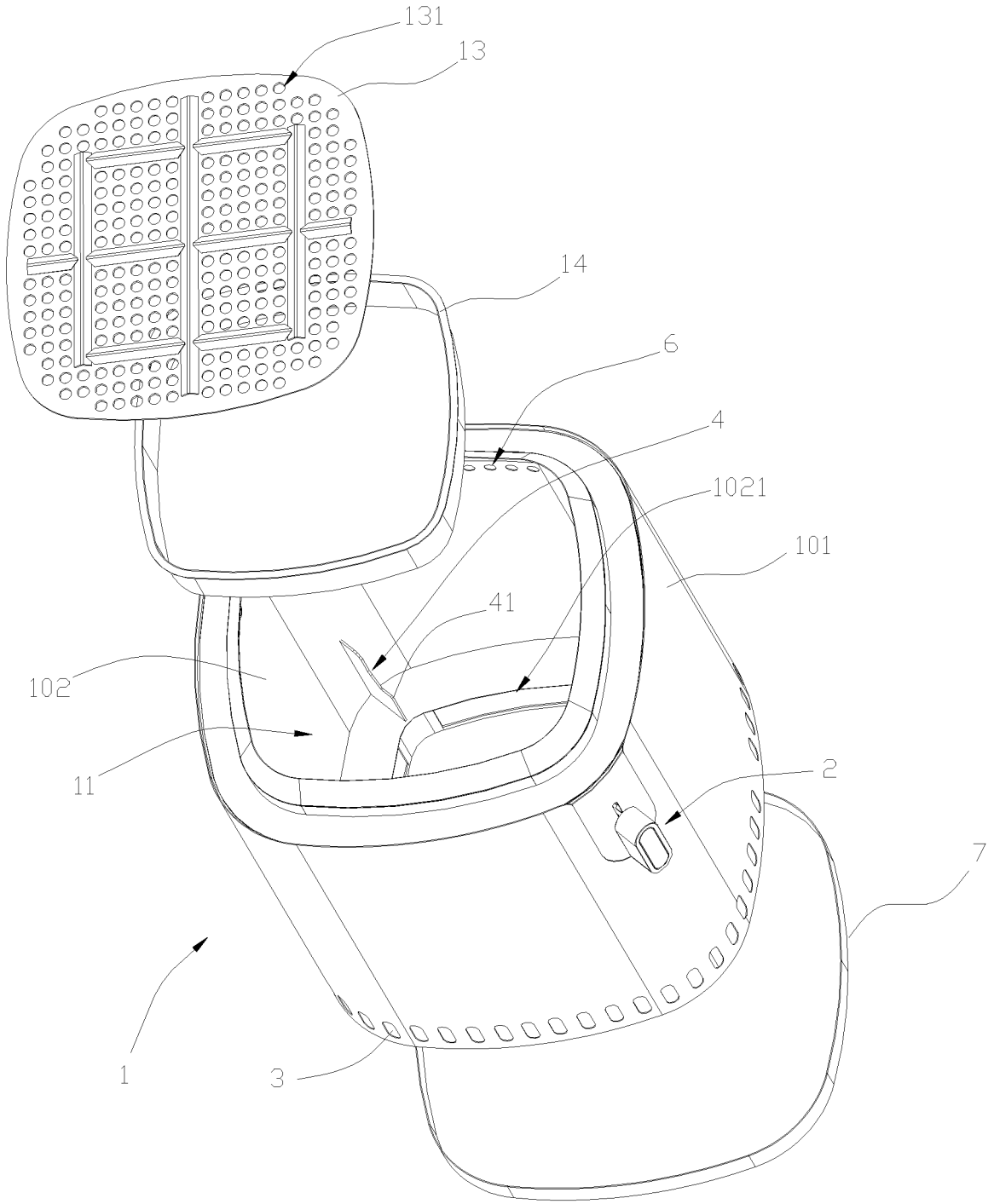
FIG. 6 shows an explosive diagram of a combustion furnace according to this embodiment.
Figure 7:
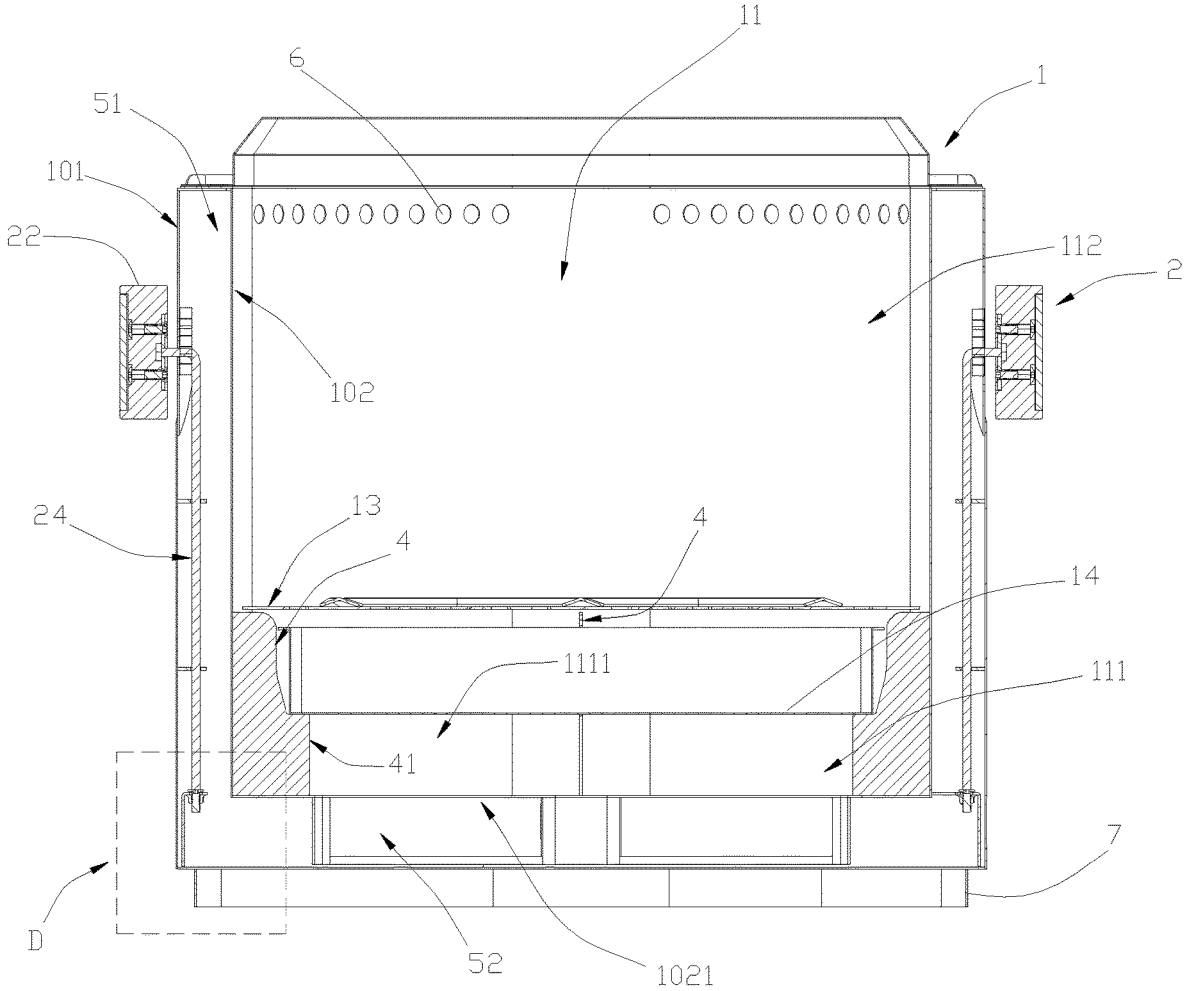
FIG. 7 shows a cross-sectional diagram of a combustion furnace according to this embodiment.

Further, in this embodiment, as shown in FIGS. 4 and 5, the furnace body is further provided with a stopper 121 at the sliding groove 12. The stopper 121 is used to fix the connecting part 23 in the sliding part when the connecting part 23 moves in the sliding groove 12. The stopper 121 includes two stopper plates facing each other, at least two limiting spaces and a recess communicating between the two limiting spaces is formed by the two stopper plates. A diameter of the recess is less than a diameter of the connection rod. Each stopper plate is formed by a clip, the connection rod is able to move between two limiting spaces via the recess when the hand-held part is operated, so that the baffle is able to turn off or turn on the air inlet. Each stopper plate includes a plurality of first plates and a plurality of V-shaped plates connected the first plates alternately, and the recess is formed between two V-shaped plates facing each other, a top of the two V-shaped plates facing each other are configured to form a limiting space of two limiting spaces.

Further, a combustion rack 13 in which wood is placed is provided in the combustion chamber 11 of this embodiment. The combustion chamber 11 forms a lower chamber 111 below the combustion rack 13. A plurality of wind shields 4 are provided in the lower chamber 111 to divide the lower chamber 111 into a plurality of chamber units 1111. The combustion rack 13 can be erected on the top of the wind shields 4. The plurality of wind shields 4 are connected an inner side surface of the lower chamber 111. Each wind shield 4 includes a connection portion connected the inner side surface and an extending portion connected a bottom of the connection portion. A top of the connection portion is configured to support the combustion rack 13. The extending portion includes a main supporting edge and a connection edge, the connection is connected between the main supporting edge and a side edge of the connection portion, the main supporting edge is configured to support a storage rack 13, the connection edge and the side edge are configured to limit the storage rack 13.

Through the above structural arrangement, when air enters the lower chamber 111 from the air inlet 3 at the bottom of the furnace body 1, air will enter different chamber units 1111, so as to prevent air from forming cyclone turbulence in the lower chamber 111 and improve the combustion efficiency of wood.

Further, a storage rack 14 is further provided in the furnace body 1 of this embodiment. The storage rack 14 is provided below the combustion rack 13, and the combustion rack 13 is provided with a plurality of through-holes 131. As an embodiment, the bottom of the wind shield 4 is provided with a protrusion 41. The storage rack 14 can be erected on the protrusion 41. Through the above structural arrangement, when the wood burns to form ashes, the ashes will fall into the storage rack 14 through the through-holes 131, which is convenient for storage and cleaning.

Further, the furnace body 1 of this embodiment includes a first furnace body unit 101 and a second furnace body unit 102. The second furnace body unit is provided in the first furnace body unit 101. Specifically, in this embodiment, the air inlet 3 is provided at the bottom of the side wall of the first furnace body unit 101. The combustion chamber 11 is provided in the second furnace body unit 102. The diameter of the first furnace body unit 101 is longer than that of the second furnace body unit 102. The bottom wall of the second furnace body unit 102 is higher than the bottom wall of the first furnace body unit 101 to form a first air passage 51 between the side wall of the second furnace body unit 102 and the side wall of the first furnace body unit 101, and form a second air passage 52 between the bottom wall of the first furnace body unit 101 and the bottom wall of the second furnace body unit 102. Further, the bottom wall of the second furnace body unit 102 is provided with an opening 1021 to realize the communication between the combustion chamber 11 and the second air passage 52.

With the above structural arrangement, when wood burns in the combustion chamber 11, air will enter the second air passage 52 between the bottom wall of the first furnace body unit 101 and the bottom wall of the second furnace body unit 102 through the air inlet 3, and then enter the combustion chamber 11 through the opening 1021 in the bottom wall of the second furnace body unit 102.

Figure 8:
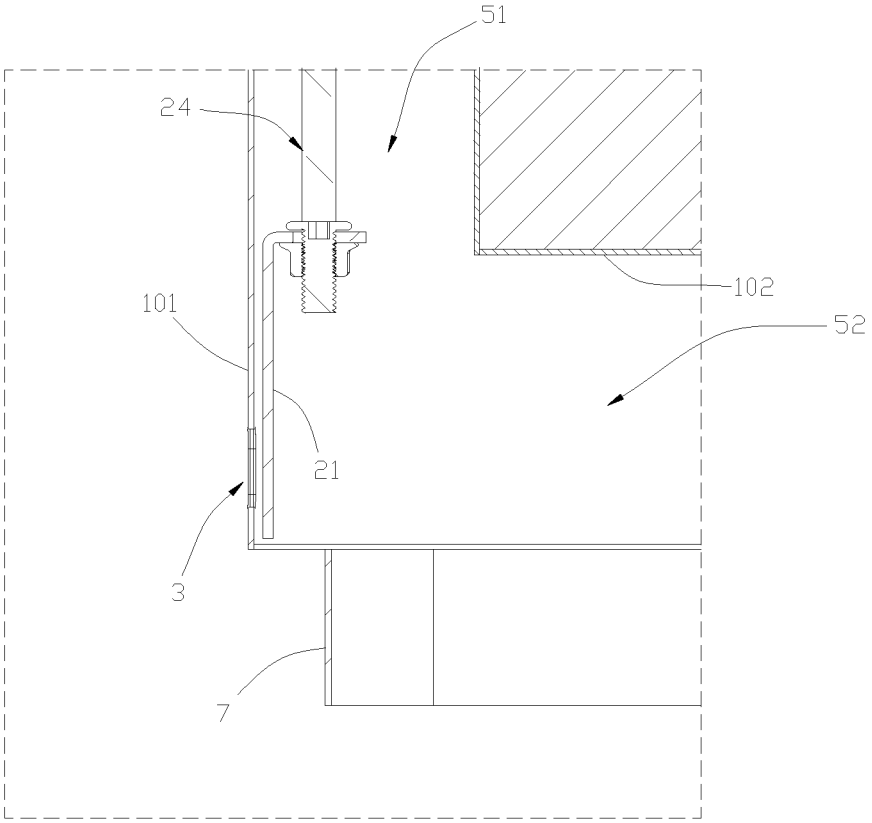
FIG. 8 shows a partial enlarged diagram at D, in which an air inlet is in an ON state.

Further, as shown in FIGS. 8 and 9, in this embodiment, the baffle 21 is provided at the bottom of the first furnace body unit 101 and closely clings to the first furnace body unit 101, and the sliding groove 12 is correspondingly provided on the side wall of the first furnace body unit 101. When the hand-held part 22 is pushed, the baffle 21 will move up and down with respect to the first furnace body unit 101.

Further, in this embodiment, the combustion chamber 11 forms an upper chamber 112 above the combustion rack 13. The side wall of the upper chamber 112 is surrounded by an air outlet 6. Air can enter the first air passage 51 through the air inlet 3 and then enter the upper chamber 112 through the air outlet 6. The air entering the upper chamber 112 can further burn the smoke in the upper chamber 112.

Further, the combustion furnace of this embodiment further includes a base 7. The base 7 is provided below the furnace body 1 for supporting the furnace body 1.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A combustion furnace with controllable firepower, comprising a furnace body, wherein the furnace body is provided with a combustion chamber in which combustible materials are placed, wherein the furnace body further comprises an adjusting mechanism and an air inlet, the air inlet is provided on the side wall of the furnace body and is configured to be communicated with the combustion chamber, the adjusting mechanism comprises a baffle, the baffle is provided at the air inlet and closely clings to the side wall of the furnace body to turn off the air inlet, and the baffle is configured to move up and down with respect to the furnace body to control the air inlet to be turned on and off, wherein the adjusting mechanism further comprises a hand-held part, a connecting part and a connecting rod, the side wall of the furnace body is longitudinally provided with a sliding groove, one end of the connecting part is connected with the hand-held part, the other end thereof is connected with one end of the connecting rod through the sliding groove, and the other end of the connecting rod is connected with the baffle, wherein the furnace body is further provided with a stopper adjacent to the sliding groove, the stopper is used to fix the connecting part in the sliding part when the connecting part moves in the sliding groove.

2. The combustion furnace with controllable firepower according to claim 1, wherein a combustion rack in which combustible materials are placed is provided in the combustion chamber, the combustion chamber forms a lower chamber below the combustion rack, a plurality of wind shields are provided in the lower chamber to divide the lower chamber into a plurality of chamber units, and the combustion rack is erected on a top of the wind shields, wherein the plurality of wind shields are connected an inner side surface of the lower chamber, each wind shield comprises a connection portion connected the inner side surface and an extending portion connected a bottom of the connection portion, a top of the connection portion is configured to support the combustion rack, the extending portion comprises a main supporting edge and a connection edge, the connection is connected between the main supporting edge and a side edge of the connection portion, and the main supporting edge is configured to support a storage rack, the connection edge and the side edge are configured to limit the storage rack.

3. The combustion furnace with controllable firepower according to claim 2, wherein the storage rack is provided below the combustion rack, and the combustion rack is provided with a plurality of through-holes, so that the ashes after burning combustible materials fall into the storage rack through the through-holes.

4. The combustion furnace with controllable firepower according to claim 1, wherein the furnace body comprises a first furnace body unit and a second furnace body unit, and the second furnace body unit is provided in the first furnace body unit;

the bottom wall of the second furnace body unit is higher than the bottom wall of the first furnace body unit to form a second air passage between the bottom wall of the first furnace body unit and the bottom wall of the second furnace body unit;

the air inlet is provided at the bottom of the side wall of the first furnace body unit, the combustion chamber is provided in the second furnace body unit, and the bottom wall of the second furnace body unit is provided with an opening to realize the communication among the combustion chamber, the second air passage and the air inlet.

5. The combustion furnace with controllable firepower according to claim 4, wherein the baffle is provided at the bottom of the first furnace body unit and closely clings to the first furnace body unit, and the sliding groove is provided on the side wall of the first furnace body unit.

6. The combustion furnace with controllable firepower according to claim 4, wherein the inner diameter of the second furnace body unit is smaller than the inner diameter of the first furnace body unit to form a first air passage between the side wall of the first furnace body unit and the side wall of the second furnace body unit.

7. The combustion furnace with controllable firepower according to claim 6, wherein the combustion chamber forms an upper chamber above the combustion rack, the side wall of the upper chamber is provided with an air outlet, and air enters the first air passage through the air inlet and then enters the upper chamber through the air outlet.

8. The combustion furnace with controllable firepower according to claim 1, further comprising a base, wherein the base is provided below the furnace body for supporting the furnace body.

9. A combustion furnace with controllable firepower, comprising a furnace body, the furnace body provided with a combustion chamber in which combustible materials are placed, the furnace body further comprising an adjusting mechanism and an air inlet, the air inlet provided on the side wall of the furnace body and configured to be communicated with the combustion chamber, the adjusting mechanism comprising a baffle, the baffle provided at the air inlet and configured to move up and down with respect to the furnace body to control the air inlet to be turned on and off, wherein the baffle is controlled to move upward so as to turn on the air inlet to increase firepower of the combustible materials and the baffle is controlled to move downward so as to turn off the air inlet to decrease the firepower of the combustible materials, wherein the adjusting mechanism further comprises a hand-held part, a connecting part and a connecting rod, the side wall of the furnace body is longitudinally provided with a sliding groove, one end of the connecting part is connected with the hand-held part, the other end thereof is connected with one end of the connecting rod through the sliding groove, and the other end of the connecting rod is connected with the baffle, wherein the furnace body is further provided with a stopper adjacent to the sliding groove, the stopper is used to fix the connecting part in the sliding part when the connecting part moves in the sliding groove.

10. The combustion furnace with controllable firepower according to claim 9, wherein a combustion rack in which combustible materials are placed is provided in the combustion chamber, the combustion chamber forms a lower chamber below the combustion rack, a plurality of wind shields are provided in the lower chamber to divide the lower chamber into a plurality of chamber units, and the combustion rack is erected on the top of the wind shields.

11. The combustion furnace with controllable firepower according to claim 10, wherein the storage rack is provided below the combustion rack, and the combustion rack is provided with a plurality of through-holes, so that the ashes after burning combustible materials fall into the storage rack through the through-holes.

12. The combustion furnace with controllable firepower according to claim 9, wherein the furnace body comprises a first furnace body unit and a second furnace body unit, and the second furnace body unit is provided in the first furnace body unit;

the bottom wall of the second furnace body unit is higher than the bottom wall of the first furnace body unit to form a second air passage between the bottom wall of the first furnace body unit and the bottom wall of the second furnace body unit;

the air inlet is provided at the bottom of the side wall of the first furnace body unit, the combustion chamber is provided in the second furnace body unit, and the bottom wall of the second furnace body unit is provided with an opening to realize the communication among the combustion chamber, the second air passage and the air inlet.

13. The combustion furnace with controllable firepower according to claim 12, wherein the baffle is provided at the bottom of the first furnace body unit and closely clings to the first furnace body unit, and the sliding groove is provided on the side wall of the first furnace body unit.

14. The combustion furnace with controllable firepower according to claim 12, wherein the inner diameter of the second furnace body unit is smaller than the inner diameter of the first furnace body unit to form a first air passage between the side wall of the first furnace body unit and the side wall of the second furnace body unit.

15. The combustion furnace with controllable firepower according to claim 14, wherein the combustion chamber forms an upper chamber above the combustion rack, the side wall of the upper chamber is provided with an air outlet, and air enters the first air passage through the air inlet and then enters the upper chamber through the air outlet.

16. The combustion furnace with controllable firepower according to claim 9, further comprising a base, wherein the base is provided below the furnace body for supporting the furnace body.

17. The combustion furnace with controllable firepower according to claim 1, wherein the stopper comprises two stopper plates facing each other, at least two limiting spaces and a recess communicating between the two limiting spaces is formed by the two stopper plates, a diameter of the recess is less than a diameter of the connection rod, each stopper plate is formed by a clip, the connection rod is able to move between two limiting spaces via the recess when the hand-held part is operated, so that the baffle is able to turn off or turn on the air inlet, each stopper plate comprises a plurality of first plates and a plurality of V-shaped plates connected the first plates alternately, and the recess is formed between two V-shaped plates facing each other, a top of the two V-shaped plates facing each other are configured to form a limiting space of two limiting spaces.

18. The combustion furnace with controllable firepower according to claim 1, wherein the other end of the connecting rod comprises a screw, the baffle comprises a main body configured to turn off the air inlet and a connection plate connected an end of the main body, the connection plate comprises a first threaded hole, the screw passes through the first threaded hole, and a nut is fixed on the screw to connect the connecting rod and the baffle.

19. The combustion furnace with adjustable firepower according to claim 9, wherein the stopper comprises two stopper plates facing each other, at least two limiting spaces and a recess communicating between the two limiting spaces is formed by the two stopper plates, a diameter of the recess is less than a diameter of the connection rod, each stopper plate is formed by a clip, the connection rod is able to move between two limiting spaces via the recess when the hand-held part is operated, so that the baffle is able to turn off or turn on the air inlet, each stopper plate comprises a plurality of first plates and a plurality of V-shaped plates connected the first plates alternately, and the recess is formed between two V-shaped plates facing each other, a top of the two V-shaped plates facing each other are configured to form a limiting space of two limiting spaces.

20. The combustion furnace with controllable firepower according to claim 19, wherein the other end of the connecting rod comprises a screw, the baffle comprises a main body configured to turn off the air inlet and a connection plate connected an end of the main body, the connection plate comprises a first threaded hole, the screw passes through the first threaded hole, and a nut is fixed on the screw to connect the connecting rod and the baffle.

* * * * *